US010164369B2

(12) United States Patent
Oberer

(10) Patent No.: US 10,164,369 B2
(45) Date of Patent: Dec. 25, 2018

(54) CONNECTION PLUG

(71) Applicant: BorgWarner Ludwigsburg GmbH, Ludwigsburg (DE)

(72) Inventor: Siegmund Oberer, Berglen-Kottweil (DE)

(73) Assignee: BorgWarner Ludwighsburg GmbH, Ludwigsburg (DE)

( * ) Notice: Subject to any disclaimer, the term of this patent is extended or adjusted under 35 U.S.C. 154(b) by 0 days.

(21) Appl. No.: 15/881,784

(22) Filed: Jan. 28, 2018

(65) Prior Publication Data

US 2018/0219320 A1 Aug. 2, 2018

(30) Foreign Application Priority Data

Jan. 31, 2017 (DE) ..... 10 2017 101 892
Feb. 9, 2017 (DE) ..... 10 2017 102 575

(51) Int. Cl.

| | |
|---|---|
| ***F02P 3/02*** | (2006.01) |
| ***H01R 13/506*** | (2006.01) |
| ***F02P 3/055*** | (2006.01) |
| ***H01R 13/53*** | (2006.01) |
| ***H01R 13/627*** | (2006.01) |
| ***H01T 13/04*** | (2006.01) |

(52) U.S. Cl.
CPC ..... *H01R 13/506* (2013.01); *F02P 3/055* (2013.01); *H01R 13/53* (2013.01); *H01R 13/6271* (2013.01); *H01T 13/04* (2013.01)

(58) Field of Classification Search
CPC .. F02P 3/02; H01F 38/12; H01T 13/04; H01T 13/05
USPC ..... 123/635, 647, 169 PA, 169 PH, 125, 127
See application file for complete search history.

(56) References Cited

U.S. PATENT DOCUMENTS

| | | | | |
|---|---|---|---|---|
| 3,497,798 | A * | 2/1970 | Schick | F02P 17/02 324/388 |
| 5,188,537 | A | 2/1993 | Itoh et al. | |
| 6,597,088 | B1 * | 7/2003 | Glaser | G01L 23/22 123/169 E |
| 7,594,489 | B1 * | 9/2009 | Marrs | H01T 13/04 123/143 C |
| 2015/0136098 | A1 * | 5/2015 | Andersson | F02P 3/02 123/634 |
| 2017/0338589 | A1 * | 11/2017 | Marrs | H01R 13/53 |
| 2018/0030947 | A1 * | 2/2018 | Anderson | F02F 1/00 |
| 2018/0102630 | A1 * | 4/2018 | Marrs | H01T 13/04 |

FOREIGN PATENT DOCUMENTS

| | | |
|---|---|---|
| CN | 203787767 U | 8/2014 |
| DE | 689 05 488 T2 | 7/1993 |
| DE | 299 10 306 U1 | 11/2000 |

(Continued)

*Primary Examiner* — Phuong Chi T Nguyen
(74) *Attorney, Agent, or Firm* — Bose McKinney & Evans LLP

(57) ABSTRACT

Described is a connection plug for connecting an ignition coil to a spark plug, comprising an electric line that has a first end for contacting an ignition coil and a second end for contacting the spark plug, a protective hose that surrounds the electric line, a protective pipe that surrounds the protective hose, wherein the protective hose is retained in the protective pipe in a positive-locking manner. The protective pipe has latching recesses at its ignition coil end, into which latching projections of the protective hose engage.

11 Claims, 4 Drawing Sheets

(56) References Cited

FOREIGN PATENT DOCUMENTS

| | | | |
|---|---|---|---|
| DE | 100 14 169 | A1 | 10/2001 |
| DE | 10 2010 039 424 | A1 | 2/2012 |
| DE | 10 2011 082 231 | A1 | 7/2012 |
| EP | O516 368 | A2 | 12/1992 |

* cited by examiner

CONNECTION PLUG

RELATED APPLICATIONS

This application claims priority to DE 10 2017 101 892.1, filed on Jan. 31, 2017, and DE 10 2017 102 575.8, filed on Feb. 9, 2017, both of which are hereby incorporated herein by reference in their entirety.

BACKGROUND

This disclosure relates to a connection plug for connecting an ignition coil to a spark plug.

The connection plug known from DE 10 2011 082 231 A1 has an electric line in the form of a helical spring that is surrounded by a protective hose. The protective hose is surrounded by a protective pipe which, at an end portion towards the spark plug, has an inwardly oriented projection that engages in a groove on the outside of the protective hose so that the protective hose is retained in the protective pipe in a positive-locking manner. The groove at the outside of the protective hose is formed by two radial circumferential projections on the inside of the protective hose which are arranged at an axial distance from one another. For retaining the protective hose at the spark plug there is provided an additional pin that is pressed into a corresponding through-hole in the protective hose and the protective pipe and thus achieves a locking between the protective hose and the protective pipe. If the protective hose needs to be pulled out of the protective pipe, the pressed-in pin first has to be removed.

A positive-locking connection between the protective hose and the protective pipe, on the one hand, has to be flexible enough so that the protective hose can be inserted into the protective pipe and, on the other hand, has to generate enough retention force so that the protective hose cannot unintentionally be pulled out of the protective pipe.

SUMMARY

This disclosure teaches a connection plug that allows for a reliable positive locking between protective hose and protective pipe, which can easily be opened if needed.

According to this disclosure, the protective pipe has latching recesses at its end towards the spark plug into which latching projections of the protective hose engage. In this manner, the latching can be performed more easily and, if needed, can be released again when the connection plug is connected to an ignition coil or detached from an ignition coil.

An advantageous refinement of this disclosure provides that the latching recesses are formed as through-holes. This feature has the advantage that the latching between protective pipe and protective hose can be easily released, if needed. Namely, when the connection plug is removed from the ignition coil, pressure can be applied on the latching projections of the protective hose through the holes of the protective pipe so that the latching projections of the protective hose disengage from the latching recesses of the protective pipe. Preferably, the latching recesses are formed as elongated through-holes.

Another advantageous refinement of this disclosure provides that the latching recesses are formed on opposite supporting arms of the protective pipe. Then, the protective hose can be unlocked simply by pressing.

The supporting arms may, for example, extend from a shoulder formed on the protective pipe. In this manner, the shoulder can advantageously form an unplugging aid. If it is desired to unplug the connection plug from the spark plug shaft of an engine, the shoulders of the supporting arms form a grip by means of which this can be easily done.

Another advantageous refinement of this disclosure provides that the latching projections are arranged on an end portion of the protective hose so that a high-voltage terminal of an ignition coil is situated between the latching projections when the connection plug is attached onto the high-voltage terminal of the ignition coil. In this manner, the engagement of the latching projections in the latching recesses of the protective pipe is secured by the high-voltage terminal of the ignition coil. When the connection plug is attached onto the high-voltage terminal of the ignition coil, the high-voltage terminal of the ignition coil thus prevents the latching projections from being pushed inwards and disengaged from the latching recesses of the protective pipe. Moreover, when attaching the connection plug, the latching projections can advantageously be pushed into the latching recesses of the protective pipe by attaching the protective hose onto the high-voltage terminal of the ignition coil.

Another advantageous refinement of this disclosure provides that the latching projections of the protective hose have an insertion chamfer. In this manner, inserting the protective hose into the protective pipe can be facilitated.

Another advantageous refinement of this disclosure provides that the end faces of the latching projections on the side towards the ignition coil are inclined walls that form an undercut. In this manner, the pull-out force of the protective hose can be increased when the latching projections of the protective hose engage in the latching recesses of the protective pipe.

BRIEF DESCRIPTION OF THE DRAWING

The above-mentioned aspects of exemplary embodiments will become more apparent and will be better understood by reference to the following description of the embodiments taken in conjunction with the accompanying drawings, wherein.

DESCRIPTION

Figure 1:
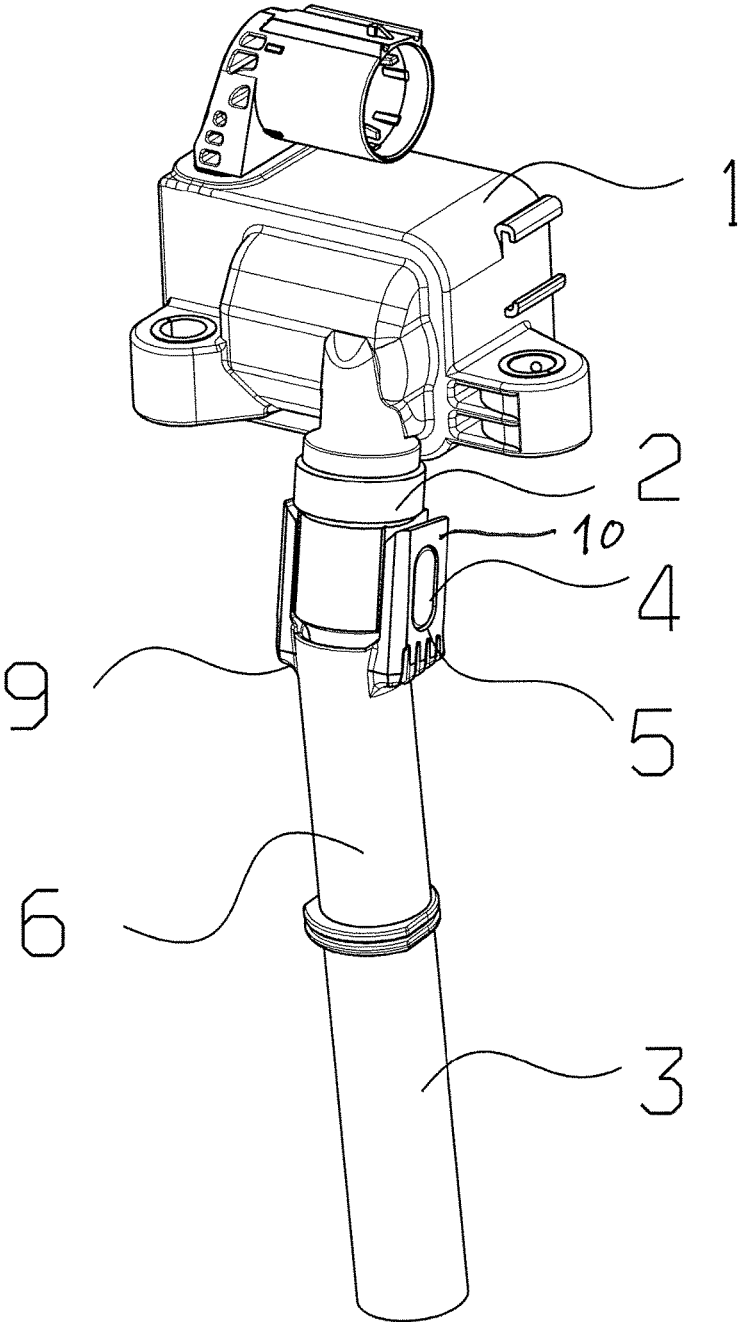
FIG. 1 shows an ignition coil with a connection plug attached thereon.
Figure 2:
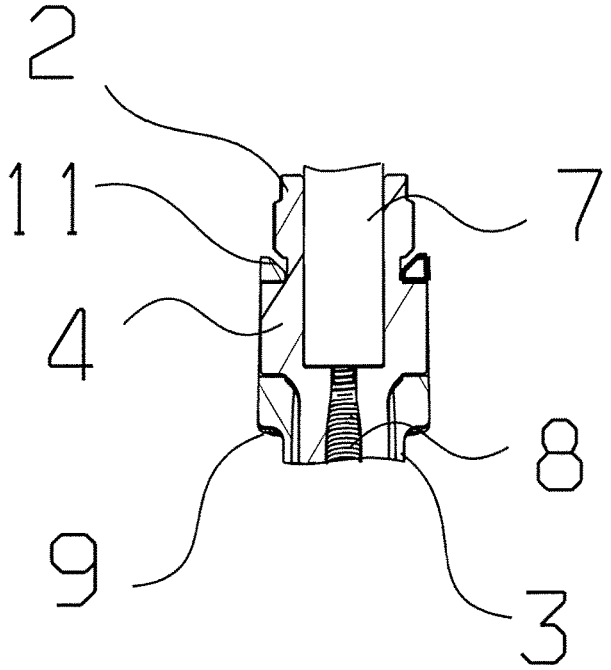
FIG. 2 shows a sectional view of the end portion of the connection plug on the side towards the ignition coil.
Figures 3, 4:
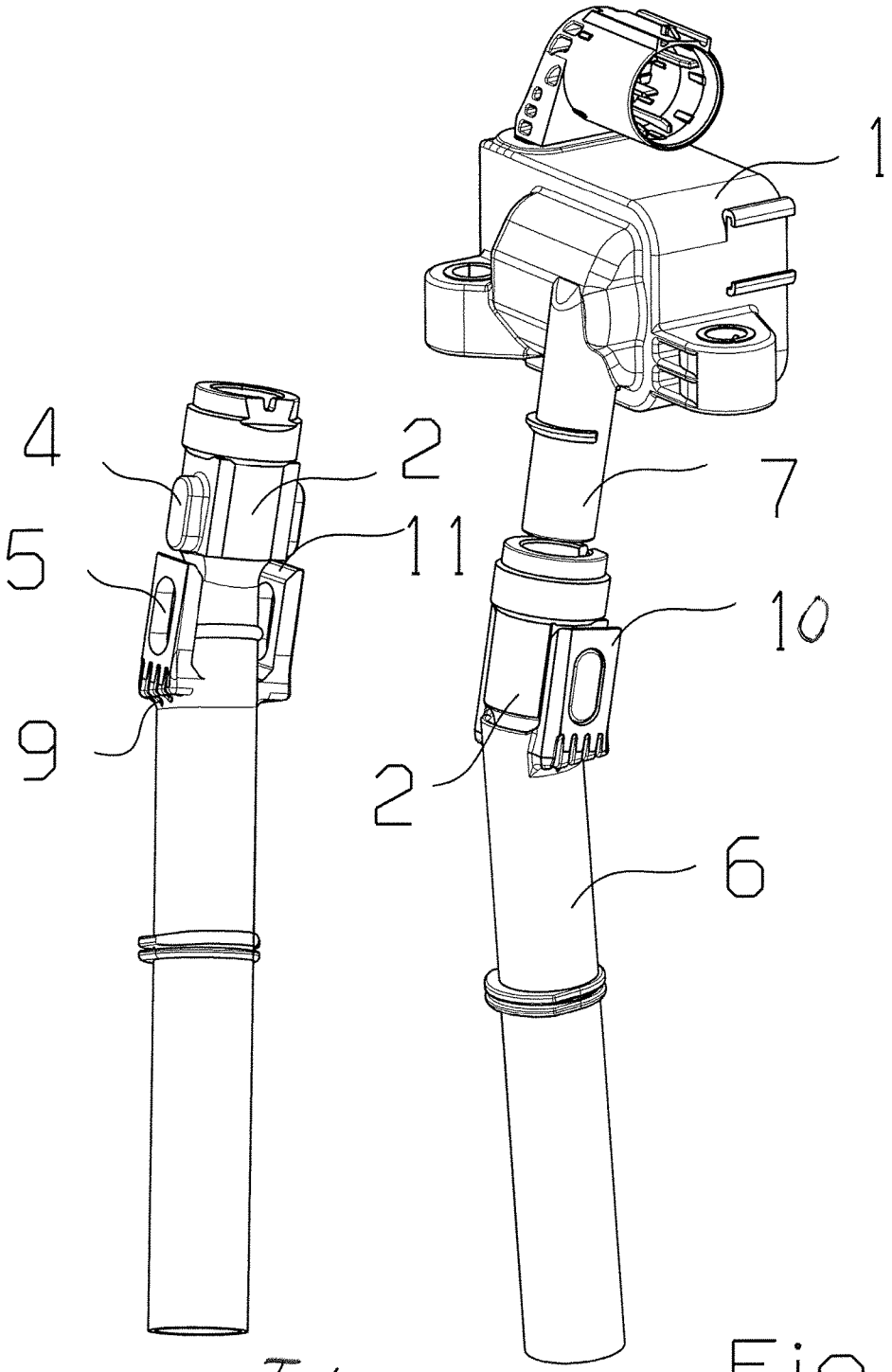
FIG. 3 shows an ignition coil with connection plug removed.
FIG. 4 shows the connection plug with the protective hose partially pulled out from the protective pipe.

The connection plug 6 illustrated in the figures is configured for connecting an ignition coil 1 to a spark plug of an internal combustion engine. The connection plug 6 includes an electric line 8 that has a first end for contacting the ignition coil 1 and a second end for contacting the spark plug. The electric line 8 can be formed as a helical compression spring, for example. The electrical line 8 is surrounded by a protective hose 2 which can be made from silicone, for example. The protective hose 2 is surrounded by a protective pipe 3 which can be made from plastics or metal, for example.

The protective hose 2 is retained in the protective pipe 3 in a positive-locking manner by the latching projections 4 of the protective hose 2 engaging in the latching recesses 5 of the protective pipe 3. The latching recesses 5 of the protective pipe 3 are provided at the connection plug's 6 end on the side configured for contacting the ignition coil, for example in the form of through-holes. In the embodiment shown, the latching recesses 5 are formed as elongated through-holes, for example.

The latching recesses 5 of the protective pipe 5 are provided in supporting arms 10 which extend from shoulders 9 formed on the protective pipe 3. The shoulder 9 forms an unplugging aid and enables a good grip of the protective pipe 3 so that the latter can be easily pulled out of the spark plug shaft of an engine, if needed. In the embodiment shown, there are exactly two supporting arms 10 which oppose one another. At their free end on the side towards the ignition coil there is an insertion chamfer 11. The insertion chamfer 11 facilitates inserting the protective hose 2 into the protective pipe 3 when assembling the connection plug 6.

The latching projections 4 are formed integrally with the protective hose 2. It is advantageous here that the latching projections 4 are arranged on an end portion of the protective hose 2 so that a high-voltage terminal 7 of the ignition coil 7 is situated between the latching projections 4, when the connection plug 6 is attached onto the ignition coil 1. The high-voltage terminal 7 then prevents the latching projections 4 from being pushed inwards and disengaging from the latching recesses 5 of the protective pipe 3.

When the connection plug 6 is not attached on a high-voltage terminal 7, the latching projections 4 can easily be pushed inwards by hand so that the positive locking between the protective pipe 3 and the protective hose 2 can be released if needed. Then, when the latching projections 4 of the protective hose 2 are pushed inwards, the protective hose 2 can be pulled out of the protective hose 3 without any problem. In addition, the protective hose 2 may have projections and/or recesses in an inner surface for a positive-locking connection with recesses and/or projections on the outside of a high-voltage terminal 7.

Figure 5:
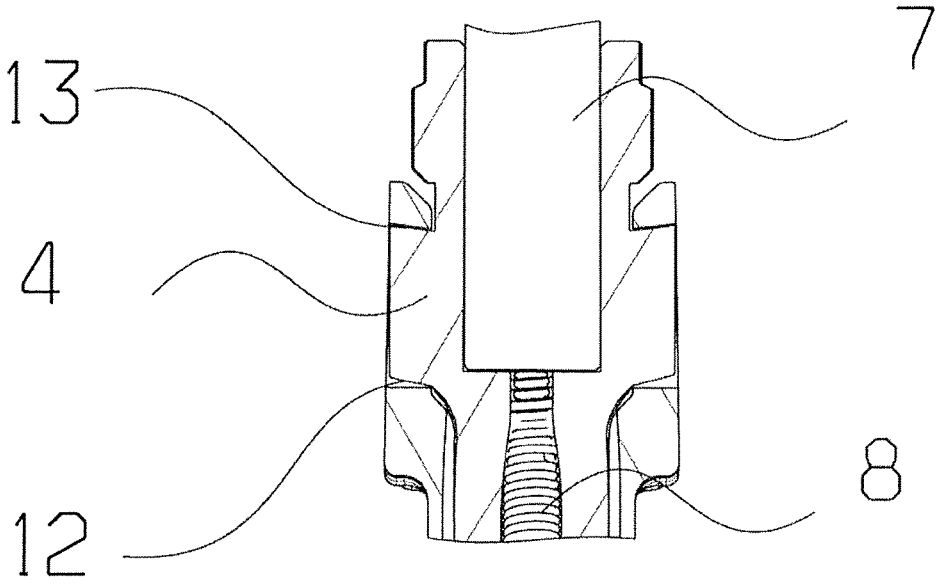
FIG. 5 shows a view according to FIG. 2 of another illustrative embodiment.

FIG. 5 shows in a sectional detailed view another embodiment that differs from the above explained embodiment in that the latching projections 4 have insertion chamfers 12 so as to facilitate the insertion of the protective hose 2 into the protective pipe 3. Moreover, the end faces of the latching projections 4 on the side towards the ignition coil can be provided as inclined walls 13 which form an undercut. This undercut increases the pull-out forces of the protective hose when the latching projections 4 engage in the latching recesses 5.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

REFERENCE LIST

1 ignition coil
2 protective hose
3 protective pipe
4 latching projections
5 latching recess
6 connection plug
7 high-voltage terminal
8 helical compression spring
9 shoulder
10 supporting arm
11 insertion chamfer
12 insertion chamfer
13 wall

What is claimed is:

1. A connection plug for connecting an ignition coil to a spark plug, comprising:

an electric line having a first end configured for contacting an ignition coil and a second end configured for contacting the spark plug;

a protective hose surrounding the electric line and having latching projections; and a protective pipe surrounding the protective hose and having latching recesses at an ignition coil end, wherein the latching recesses of the protective pipe engage the latching projections of the protective hose to thereby retain the protective hose in the protective pipe.

2. The connection plug according to claim 1, wherein the latching recesses are through-holes.

3. The connection plug according to claim 1, wherein the latching projections of the protective hose are integrally formed with the protective hose.

4. The connection plug according to claim 1, wherein the latching projections and the protective hose are formed from silicone.

5. The connection plug according to claim 1, wherein the protective hose has projections and/or recesses on an inner surface configured for a positive-locking connection with recesses and/or projections on an outside of a high-voltage terminal of an ignition coil.

6. The connection plug according to claim 1, wherein at least one portion of the electric line has a helical compression spring.

7. The connection plug according to claim 1, wherein the latching projections are arranged on an end portion of the protective hose so that a high-voltage terminal of an ignition coil can be situated between the latching projections when the connection plug is attached onto the high-voltage terminal of the ignition coil.

8. The connection plug according to claim 7, wherein the high voltage terminal prevents the latching projections from disengaging from the latching recess.

9. The connection plug according to claim 1, wherein the latching recesses are arranged on opposing supporting arms of the protective pipe.

10. The connection plug according to claim 9, wherein the supporting arms have an insertion chamfer at free ends thereof configured to facilitate sliding onto the latching projections of the protective hose.

11. The connection plug according to claim 9, wherein the supporting arms extend from a shoulder formed on the protective pipe.

* * * * *